US010905305B2

(12) United States Patent
Monsrud et al.

(10) Patent No.: US 10,905,305 B2
(45) Date of Patent: Feb. 2, 2021

(54) AUTOMATED CLEANING METHOD AND APPARATUS

(75) Inventors: Lee J. Monsrud, Inver Grove Heights, MN (US); Paul J. Mattia, Prior Lake, MN (US)

(73) Assignee: Ecolab USA Inc., Saint Paul, MN (US)

( * ) Notice: Subject to any disclaimer, the term of this patent is extended or adjusted under 35 U.S.C. 154(b) by 519 days.

(21) Appl. No.: 13/112,412

(22) Filed: May 20, 2011

(65) Prior Publication Data

US 2012/0291808 A1 Nov. 22, 2012

(51) Int. Cl.

| | |
|---|---|
| ***A47L 15/42*** | (2006.01) |
| ***B08B 7/04*** | (2006.01) |
| ***A47L 15/00*** | (2006.01) |
| ***B08B 3/02*** | (2006.01) |

(52) U.S. Cl.

CPC ..... *A47L 15/0055* (2013.01); *B08B 3/02* (2013.01); *A47L 2301/02* (2013.01); *A47L 2301/06* (2013.01); *A47L 2401/04* (2013.01); *A47L 2401/11* (2013.01); *A47L 2501/07* (2013.01); *A47L 2501/20* (2013.01); *A47L 2501/30* (2013.01)

(58) Field of Classification Search

CPC .... B08B 3/02; A47L 15/0055; A47L 15/4282; A47L 2501/30; A47L 2401/04; A47L 2501/07; A47L 15/4418; A47L 2301/06; A47L 2401/11; A47L 2301/02; A47L 2501/20

USPC ..... 134/18, 25.2, 56 D, 57 D, 58 D; 700/90, 700/213, 225; 8/147, 158, 159

See application file for complete search history.

(56) References Cited

U.S. PATENT DOCUMENTS

| | | | | |
|---|---|---|---|---|
| 2,624,619 A * | 1/1953 | Fletcher | A47L 17/00 134/172 |
| 5,131,419 A | 7/1992 | Roberts | |
| 5,399,284 A | 3/1995 | Schreiber | |
| 5,644,936 A * | 7/1997 | Yasutake et al. | 68/12.02 |
| 5,715,555 A * | 2/1998 | Reber et al. | 8/158 |

(Continued)

FOREIGN PATENT DOCUMENTS

| | | |
|---|---|---|
| CN | 101014276 A | 8/2007 |
| DE | 102008017597 A1 * | 10/2009 |

(Continued)

OTHER PUBLICATIONS

"Dishwasher", English Abstract, pp. 1-14.

(Continued)

*Primary Examiner* — Alexander Markoff

(74) *Attorney, Agent, or Firm* — McKee, Voorhees & Sease, PLC

(57) ABSTRACT

An automated method and apparatus for cleaning articles by direct application of concentrated product to a soiled surface of the article is disclosed. The article type is identified and a product dispensing sequence is activated to control the type of product dispensed onto the articles based on the article type and/or soil type on the article. Product, duration, and other parameters are tailored according to the article type and/or soil type during each sequence of the wash cycle. Product, wash and rinse liquids are applied at specific locations and from specific directions from within the cleaning apparatus based upon the article type and/or soil type on the article.

19 Claims, 4 Drawing Sheets

(56) References Cited

U.S. PATENT DOCUMENTS

| | | | | |
|---|---|---|---|---|
| 5,771,909 | A * | 6/1998 | Hein et al. | 134/57 D |
| 6,117,357 | A * | 9/2000 | Kott | C11D 3/3917 252/186.38 |
| 6,463,940 | B1 * | 10/2002 | Thomas | A47L 15/0055 134/113 |
| 7,437,213 | B2 | 10/2008 | Batcher | |
| 8,229,204 | B2 * | 7/2012 | Wagner | 382/141 |
| 8,509,473 | B2 * | 8/2013 | Wagner | 382/100 |
| 2004/0088075 | A1 * | 5/2004 | Batcher | A47L 15/0063 700/225 |
| 2004/0194810 | A1 | 10/2004 | Strothoff et al. | |
| 2005/0022314 | A1 | 2/2005 | Ambuter et al. | |
| 2005/0096788 | A1 | 5/2005 | Peterson et al. | |
| 2006/0216217 | A1 * | 9/2006 | Chan | A47L 15/4297 422/218 |
| 2007/0181162 | A1 * | 8/2007 | Classen et al. | 134/25.2 |
| 2007/0272272 | A1 | 11/2007 | Choi et al. | |
| 2008/0276965 | A1 | 11/2008 | Aykroyd et al. | |
| 2010/0287709 | A1 | 11/2010 | Doyle et al. | |
| 2011/0017235 | A1 | 1/2011 | Berner et al. | |

FOREIGN PATENT DOCUMENTS

| | | | | |
|---|---|---|---|---|
| EP | 0980668 | A2 | | 2/2000 |
| JP | 5435584 | A | | 3/1979 |
| JP | 1152199 | A | | 6/1989 |
| JP | 458932 | A | | 2/1992 |
| JP | 2000014624 | A | | 1/2000 |
| JP | 2003093315 | A | | 4/2003 |
| JP | 2003530182 | A | | 10/2003 |
| JP | 2005052470 | A | | 3/2005 |
| JP | 2005095322 | A | | 4/2005 |
| JP | 2005237537 | A | * | 9/2005 |
| JP | 2006026320 | A | | 2/2006 |
| JP | 2008229401 | A | | 10/2008 |
| JP | 201130975 | A | | 2/2011 |
| KR | 100695173 | B1 | | 3/2007 |
| WO | 199217564 | A | | 10/1992 |
| WO | 2003053204 | A2 | | 7/2003 |
| WO | WO 2009126482 | A1 | * | 10/2009 |
| WO | 0246348 | A1 | | 6/2013 |

OTHER PUBLICATIONS

"Dishwasher Having a Detergent Concentration Measuring Sensor and a Dish-Washing Method Using the Same for Effectively Removing a Stain on Tableware by Rinsing the Tableware According to a Detergent Concentration", English Abstract, p. 1.

Ecolab USA Inc., et al., PCT/ID2012/052496, "Notification of Transmittal of the International Search Report and the Written Opinion of the International Searching Authority, or the Declaration", dated Dec. 28, 2012.

JP2005237537, Matsushita Electric Ind Co Ltd—English Translation. Aug. 9, 2005.

European Patent Office, "Extended European Search Report", Issued in connection with International Application No. PCT/IB2012052496, 8 pages, dated Mar. 13, 2015.

EP2510863—Chemische Fabrik Dr. Weigert GmbH & Co.—English Translation.

DE 19808607—AEG Hausgerate GmbH—English Translation.

* cited by examiner

Soft Water - No "Hard Water Signal" Detected

| Detergent Concentration: | 0.10% |
|---|---|

| Ware Type Detetected | Step 1 | | | | Step 2 | | | | Step 3 | | | | Step 4 - Final Rinse | | |
|---|---|---|---|---|---|---|---|---|---|---|---|---|---|---|---|
| | Step Time (sec.) | Recirculated Wash | Conc. Chem. Spray | Spray From | Step Time (sec.) | Recirculated Wash | Conc. Chem. Spray | Spray From | Step Time (sec.) | Recirculated Wash | Conc. Chem. Spray | Spray From | Step Time (sec.) | Conc. Chem. Spray | Spray From |
| Plates | 10.0 | 0.10% | XXXX | Top | 4.0 | XXXX | Acid | Top | 25.0 | 0.10% | XXXX | Both | 10.0 | XXXX | Top |
| Cups | 3.0 | XXXX | Oxidizer | Bottom | 40.0 | 0.10% | XXXX | Bottom | 1.0 | XXXX | Oxidizer | Bottom | 5.0 | XXXX | Bottom |
| Glasses | 4.0 | XXXX | Oxidizer | Bottom | 45.0 | 0.10% | XXXX | Both | 3.0 | XXXX | Acid | Both | 12.0 | Surfact. | Both |
| Flatware | 20.0 | XXXX | Enzyme | Top | 50.0 | 0.10% | XXXX | Top | 2.0 | XXXX | Surf | Top | 12.0 | Surfact. | Both |
| Pots & Pans | 15.0 | XXXX | Surfact. | Bottom | 90.0 | 0.10% | XXXX | Bottom | XXXX | XXXX | XXXX | XXXX | 8.0 | XXXX | Bottom |
| Aluminum Sheet Pans | 100.0 | 0.10% | XXXX XXXX | Top | XXXX XXXX | XXXX XXXX | XXXX XXXX | XXXX XXXX | XXXX XXXX | XXXX XXXX | XXXX XXXX | XXXX XXXX | 6.0 | XXXX XXXX | Top |

Hard Water - "Hard Water Signal" Detected

| Detergent Concentration: | 0.16% |
|---|---|

| Ware Type Detetected | Step 1 | | | | Step 2 | | | | Step 3 | | | | Step 4 - Final Rinse | | |
|---|---|---|---|---|---|---|---|---|---|---|---|---|---|---|---|
| | Step Time (sec.) | Recirculated Wash | Conc. Chem. Spray | Spray From | Step Time (sec.) | Recirculated Wash | Conc. Chem. Spray | Spray From | Step Time (sec.) | Recirculated Wash | Conc. Chem. Spray | Spray From | Step Time (sec.) | Conc. Chem. Spray | Spray From |
| Plates | 10.0 | 0.16% | XXXX | Top | 4.0 | XXXX | Acid | Top | 25.0 | 0.16% | XXXX | Both | 10.0 | XXXX | Top |
| Cups | 3.0 | XXXX | Chelant | Bottom | 40.0 | 0.16% | XXXX | Bottom | 1.0 | XXXX | Oxidizer | Bottom | 5.0 | XXXX | Bottom |
| Glasses | 4.0 | XXXX | Chelant | Bottom | 45.0 | 0.16% | XXXX | Both | 3.0 | XXXX | Acid | Both | 12.0 | Surfact. | Both |
| Flatware | 20.0 | XXXX | Enzyme | Top | 50.0 | 0.16% | XXXX | Top | 2.0 | XXXX | Surf | Top | 12.0 | Surfact. | Both |
| Pots & Pans | 15.0 | XXXX | Surfact. | Bottom | 90.0 | 0.16% | XXXX | Bottom | XXXX | XXXX | XXXX | XXXX | 8.0 | XXXX | Bottom |
| Aluminum Sheet Pans | 100.0 | 0.16% | XXXX XXXX | Top | XXXX XXXX | XXXX XXXX | XXXX XXXX | XXXX XXXX | XXXX XXXX | XXXX XXXX | XXXX XXXX | XXXX XXXX | 6.0 | XXXX XXXX | Top |

*FIG. 2*

AUTOMATED CLEANING METHOD AND APPARATUS

FIELD OF THE INVENTION

The invention relates generally to an automated cleaning method and apparatus, and more particularly to an automated cleaning method and apparatus for controlling direct application of concentrated product onto an article to be cleaned based on the type of and/or soil on the article.

BACKGROUND OF RELATED ART

In a traditional cleaning apparatus or method, the article and soils, notwithstanding the differences in the articles being cleaned and the soil type, are cleaned with the same chemicals, often present in the bulk cleaning liquid. For example, depending upon the article to be cleaned, various chemicals are used that are either not needed, are caustic to the article type, or fail to provide the best end result. In a typical dishwasher cycle, water fills the bulk wash tank of the dishwasher and cleaning chemicals and detergents are added to the water in the bulk wash tank. The water is pumped by a wash pump to the rotating spray arms. The spray water washes the dishes and returns to the bulk wash tank, where it is recycled after being filtered. The dishes are then rinsed with fresh water, sanitized and dried. Some bulk wash tanks are manually drained and refilled after multiple washes whereas some are automatically drained every one or more cycles.

It is therefore desirable to provide a cleaning method and apparatus that, before a product is dispensed for cleaning the article, the article type and/or soil type is identified. The products to be dispensed are identified along with a preferred product dispensing sequence based upon the article and/or soil type.

It is further desirable to provide an automated cleaning method and apparatus that, in addition to recirculating the bulk solution has the capability to apply concentrated product directly onto the article being cleaned; the product selection is based on the type of article and/or soil type on the article.

SUMMARY OF THE INVENTION

In accordance with the present invention, the above and other problems are solved by providing an automated cleaning method and apparatus. In one embodiment, the invention is an automated cleaning method. The method includes the steps of providing a cleaning apparatus, determining the concentrated product(s) to dispense based on the type of article to be cleaned, directly applying the concentrated product(s) to the article and cleaning the article with the applied product(s). The method also includes identifying the article type and controlling the type of concentrated product(s) to be dispensed based on the article type. The dispensing sequence for each concentrated product is also controlled based on identification of the article and/or soil type.

In another embodiment, the invention is an automated cleaning method for cleaning wares. The method includes providing a cleaning apparatus for cleaning wares, determining a concentrated product to dispense onto the wares based on the ware type, directly applying the product to the ware, and cleaning the ware with the applied product. The method also includes providing a cleaning apparatus for cleaning soiled wares, determining a concentrated product to dispense onto the wares based on the soil type, directly applying the product onto the soiled portion of the wares, and cleaning soil from the ware with the applied product. In a preferred form, the method also includes controlling location of product application on a surface of the ware based on the ware and/or soil type.

In another embodiment, the invention is an automated cleaning apparatus. The apparatus includes one or more product dispensing points providing direct application of a concentrated product onto an article to be cleaned and a control device providing a product dispensing signal to dispense product at the product dispensing points based on a type of the article to be cleaned. In a preferred form, the automated cleaning apparatus includes a product dispense sequence for controlling a concentrated product type dispensed at the product dispensing points based on the article and/or soil type.

BRIEF DESCRIPTION OF THE DRAWINGS

FIG. 2 illustrates an exemplary table of cleaning parameters for the dispensing sequence according to one possible embodiment of the present invention.

DETAILED DESCRIPTION OF THE PREFERRED EMBODIMENTS

The present invention provides an automated cleaning method and apparatus for cleaning articles according to the particular type of article and/or the soil type on the article.

Figure 1:
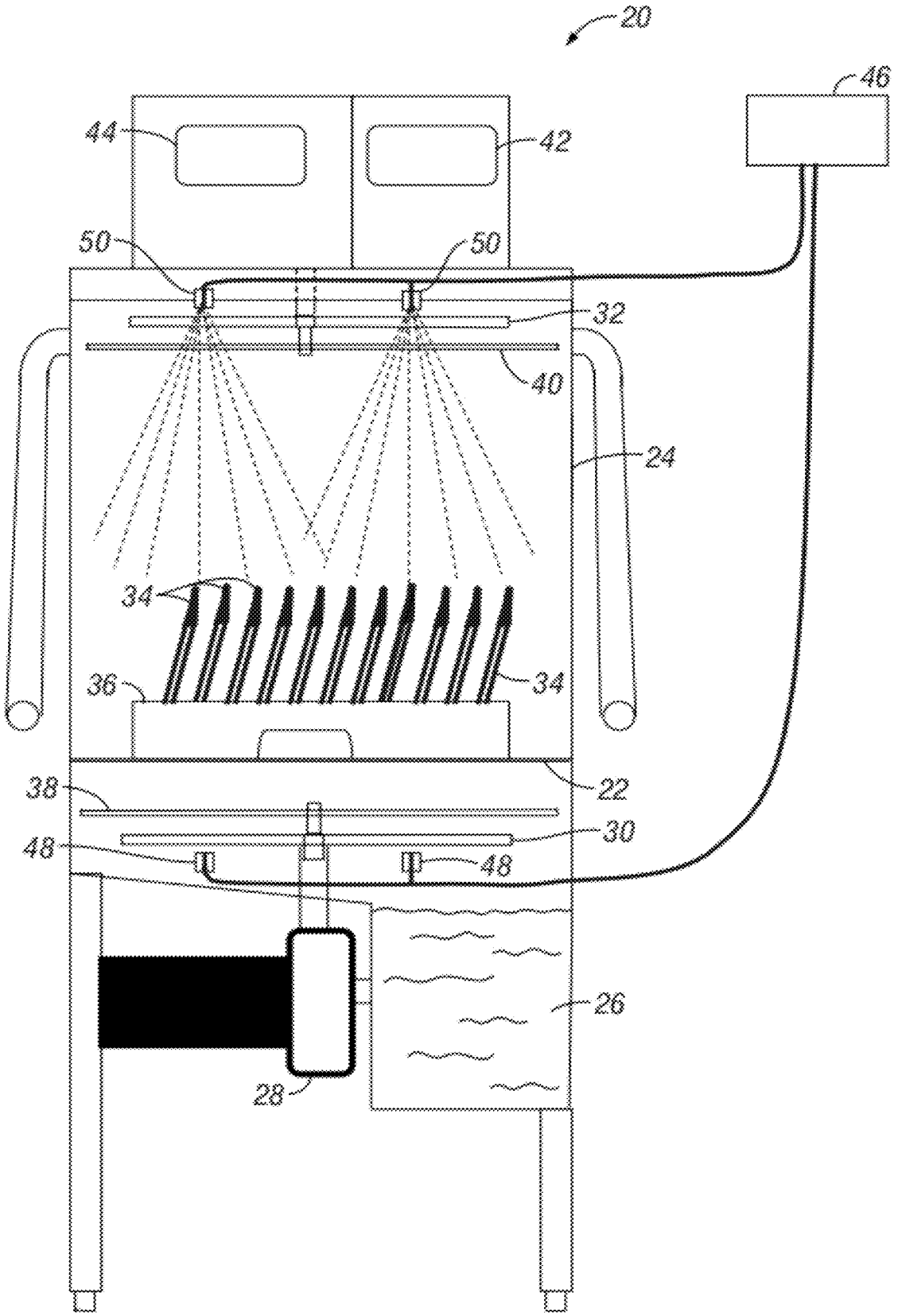
FIG. 1 illustrates the components of the automated cleaning apparatus according to one embodiment of the present invention.

Referring to FIG. 1, the components of an automated cleaning apparatus 20 are illustrated according to one exemplary embodiment of the present invention. The cleaning apparatus 20 includes a shelf 22 which the articles to be washed are placed. The cleaning apparatus 20 may be a commercial recirculated wash type dish machine with a standard dish rack, although other cleaning apparatuses may be employed, including without limitation cleaning apparatuses for cleaning articles where direct application of the cleaning or concentrated product to the article provides benefits over existing systems.

The cleaning apparatus 20 includes a cabinet body 24 housing the shelf 22. A wash tank 26 is included for holding generally a large amount of bulk wash liquids used in the cleaning process. A pump is connected in fluid communication with the wash tank 26 for increasing the pressure of the liquid in the wash tank 26 and directing it to wash spray arms 30 and 32. The wash spray arms 30 and 32 include nozzles for directing the liquid onto the articles 34 in the rack 36. In addition to the lower and upper wash spray arm 30 and 32, the cleaning apparatus 20 may include a lower rinse spray arm 38 and an upper rinse spray arm 40 for directing rinsing liquids onto articles 34 in the rack 36. The spray pressure may be controlled by controlling the pump action or by use of a manifold valve (not shown). For example, when washing a lighter, plastic article, a lower spray pressure from the lower wash or rinse arm may be desirable so as not to disorientate the article within the cleaning apparatus 20.

An identifier (not shown) is positioned on the rack 36. This will allow identification of the types of articles 34 loaded onto the rack 36. Methods and systems for recognizing the identifier are disclosed in a commonly owned U.S. Pat. No. 7,437,213 to Batcher, issued Oct. 15, 2002, which is incorporated by reference herein in its entirety. The identifier is preferably pre-programmed with unique identifying information, such as an identifier value indicating the type of rack 36 being used, i.e., a rack designated for cups, plates, flatware, glasses, pots and pans, etc. Identification of the articles could also be done, for example, by use of specifically designed ware racks 36; by use of optical recognition; by use of bar codes; by color of the rack 36; by affixing a transponder to the articles 34 themselves; or by use of a proximity sensor. Examples of various types of articles 34 include without limitation, glassware, pots and pans, plates, cups, flatware, coffee cups, aluminum sheet pans, and any other article type associated with a common cleaning sequence, such as those that could be cleaned using apparatus 20 of the present invention.

Figure 4:
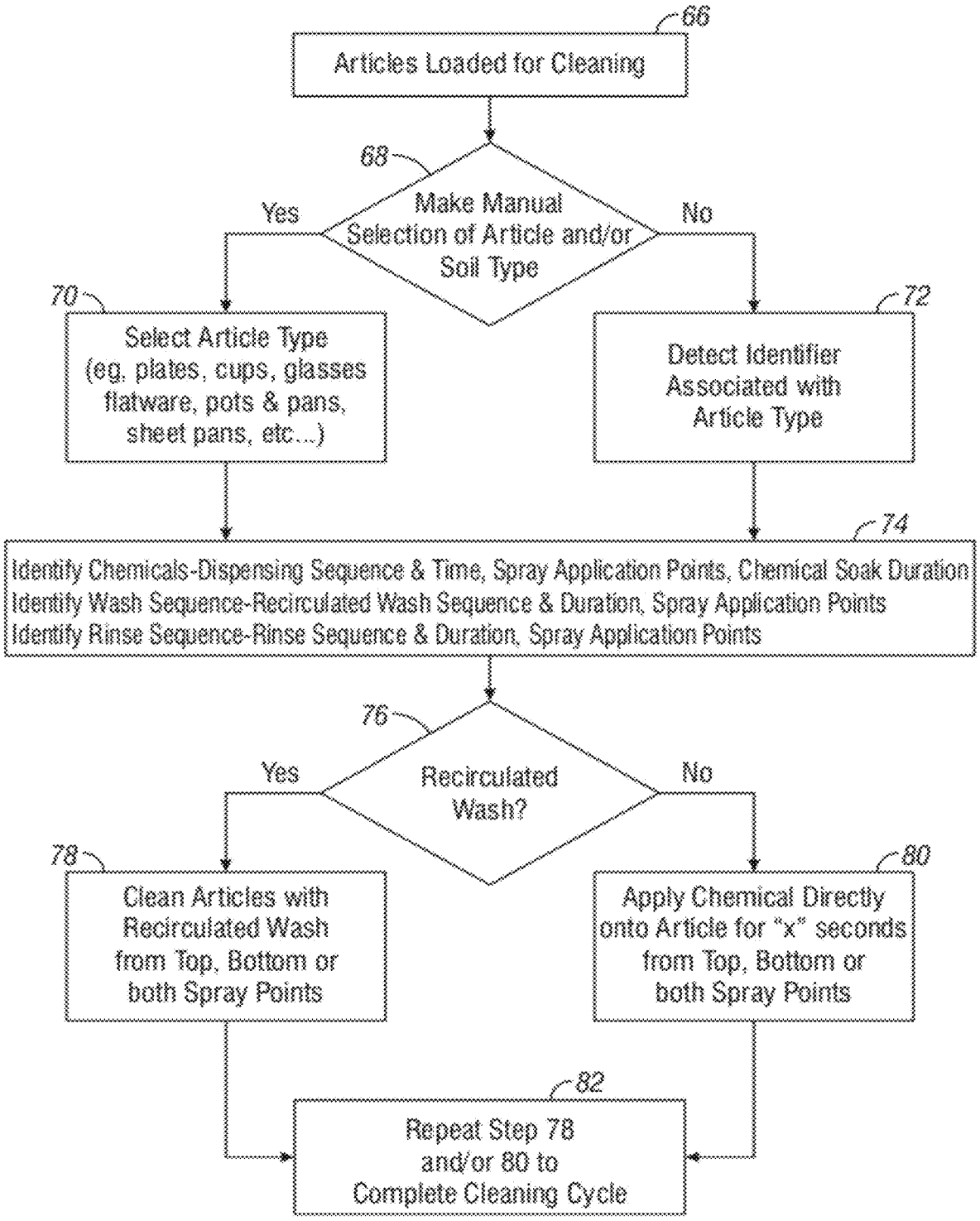
FIG. 4 is a flow chart illustrating the dispensing, wash and rinse sequence for article-dependent cleaning according to one possible embodiment of the present invention.

The cleaning apparatus 20 could also include a user interface, such as a Graphical User Interface (GUI), for an operator or user to manually input the type of articles 34 loaded onto the rack 36, such as illustrated at step 70 in FIG. 4. Using the automated article identifying method and system described above and incorporated by reference herein, the control device upon detection of the identifier associated with the rack 36 indicating the type of articles 34 to be cleaned, may be displayed at the user interface 42 for indicating to the operator or user the type of articles or wares that the cleaning apparatus 20 has identified in the rack 36.

The cleaning apparatus 20 also includes a chemical dispenser 46 adapted to receive chemical dispensing instructions from the controller 44. The dispenser 46 may include any number of cleaning or concentrated products, such as cleaning chemicals for dispensing to the cleaning apparatus 20. The dispenser 46 includes one or more dispenser pumps. For example, depending upon the number of chemicals being dispensed, the number of dispenser pumps may be altered accordingly. In an exemplary embodiment of the present invention, the dispenser 46 includes three or more, or six or less dispenser pumps. Additional dispenser pumps are possible. The term pump could be an aspirator or other means for delivering a chemical to be sprayed onto the soiled surface of the articles loaded in the rack 36. The dispenser 46 can be connected in fluid communication with spray points within the body of the cleaning apparatus 20. In one aspect of the present invention, the cleaning apparatus 20 includes one or more lower spray points 48 and/or one or more upper spray points 50. The upper and lower spray points 48 and 50 include nozzles with an opening directed at the rack 36 and articles 34 in the rack 36. Depending upon the article and/or the soil type on the article, the controller 44 provides a dispensing instruction to the dispenser 46 for spraying product, such as chemicals, from either the top or bottom or both spray points within the cleaning apparatus 20. The spray points are generally determined based on the type of ware and/or the soil type on the ware being cleaned. For cups, product is sprayed directly onto the cups loaded in the rack 36 from the lower spray points 48 to apply product onto the soiled inner surface of the cups. For example, to effectively remove tea and coffee stains from coffee cups, the concentrated product is dispensed from the lower spray points since cups are traditionally loaded face down in the rack 36. Similarly, for plates, the product is sprayed from the upper spray points 50 so as to be applied directly to the surface of the plate needing to be cleaned. Since plates generally face upward when loaded in the rack 36, applying product from the upper spray points 50 provides the most efficient and effective use of product being dispensed directly onto the plates. Conversely, applying concentrated product from the lower spray points 48 to the backside of the plates is wasteful. Product could be dispensed from both the lower spray point 48 and the upper spray points 50 simultaneously if needed for articles that are soiled on both the top and bottom surfaces. In another aspect of the present invention, concentrated chemical is applied to the articles 34 using the lower rinse spray arm 38 and/or the upper rinse spray arm 40 based upon the concentrated product dispense cycle, the wash cycle or the rinse cycle. In this embodiment, the dispenser 46 is connected in fluid communication with the lower rinse spray arm 38 and the upper rinse spray arm 40 for directing concentrated product from the dispenser onto the onto articles 34 in the rack 36. Thus, the cleaning apparatus 20 may be configured without the upper and lower spray points 48 and 50 shown in FIG. 2 when the dispenser applies concentrated product onto the articles 34 using the lower rinse spray arm 38 and the upper rinse spray arm 40. In this manner, cleaning products such as chemicals are only applied generally to the soiled surface of the article being cleaned rather than all the surfaces of the article. Although the cleaning apparatus 20 illustrates both lower and upper spray points 48 and 50, the present invention contemplates that additional spray points may be included depending on the ware type being cleaned. For example, spray points may be included at side or corner locations within the cabinet body of the cleaning apparatus 20 to provide the best angle for spraying and applying cleaning or concentrated product directly onto the soiled surface of the articles 34.

The controller 44 of the present invention is programmed to spray concentrated product, wash liquid and rinse liquid from the upper and/or lower spray points 48 and 50 based upon at least one or more of the following factors, including the product dispensing sequence, the article type, soil type, ware type, water condition, the concentrated product type, the wash cycle, the rinse cycle, the detergent concentration of the recirculated wash, etc.

The present invention contemplates that the cleaning apparatus 20 may include any number of product dispensing sequences stored on a data storage device (not shown) in operable control and communication with controller 44. The data storage device (not shown) may be used to store an array of pre-determined chemical combinations and cycle sequences and durations specifying cleaning chemicals to be used according to the various types of articles and/or soil type. FIG. 2 illustrates and exemplary table of cleaning parameters for one or more dispensing sequences according to exemplary embodiments of the present invention.

The controller 44 in combination with the data storage device (not shown) could be considered a memory storage unit which includes an array for identifying information and a corresponding array of custom processing parameters tailored according to the article and/or soil type on the article to be cleaned. Such information associated with each type of article and/or the soil type on the article to be cleaned could include corresponding chemical types to be used, the amounts of each chemical to be used, the dispensing sequence for each of the chemicals to be used, the cycle duration for each chemical, the cycle duration and pressure for the recirculated wash cycle, etc. In each instance where chemical is applied to the article and/or the soil on the article, the chemical is applied directly to the soiled surface of the article being cleaned.

Figure 3:
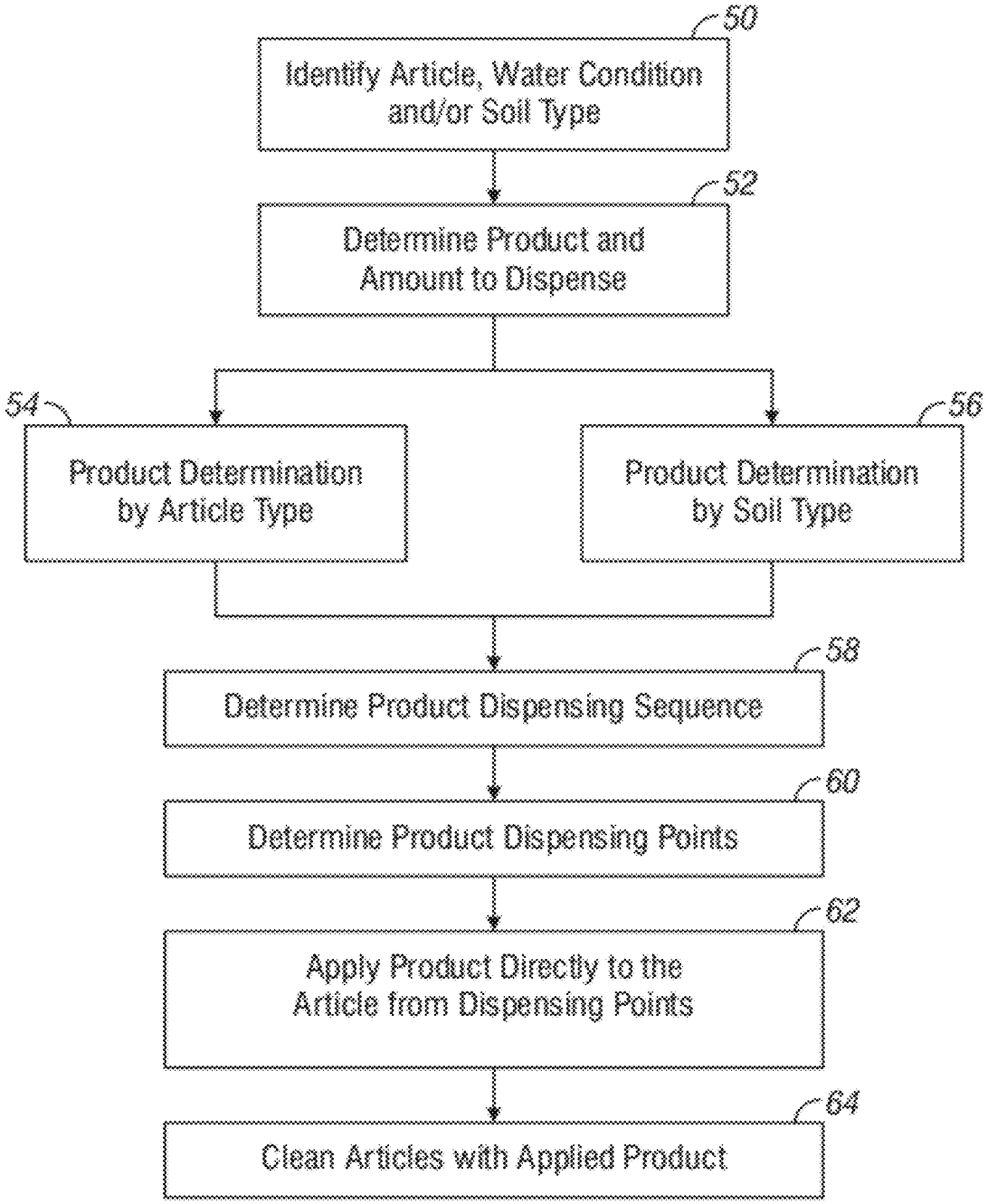
FIG. 3 is a flow chart illustrating the steps for automated cleaning according to an exemplary embodiment of the present invention.

As illustrated in FIG. 3, once the article and/or soil type has been identified (see step 50) using the methods described above and incorporated by reference of U.S. Pat. No. 7,437,213 issued Oct. 4, 2008, the controller 44 determines the appropriate concentrated product to dispense onto the soiled surface of the article to be cleaned according to step 52. As illustrated in steps 54 and 56, the product determination can be based upon the article type and/or the soil type. For example, when coffee cups are detected as the article type, certain concentrated chemicals are selected, such as a concentrated chlorine, oxidizer or chelater, for direct spray application onto the soiled surface of the cup. Similarly when pots or pans are detected as the ware type, a concentrated grease-cutting surfactant, metal protectant, or penetrant is sprayed directly onto the pots and pans. The contact time of the chemical on the pots and pans is controlled to allow the surfactant to work. In the wash cycle, the recirculated wash duration may be increased to provide additional mechanical action for cleaning the pots and pans. Once the article type is identified, a product or chemical dispensing sequence is determined according to step 58. The type of ware being cleaned also determines the dispensing points for the chemicals to be applied directly onto the soiled surface of the articles being cleaned (see step 60). Having identified the one or more chemicals to spray directly onto the soiled surface of the article, the controller 44 communicates a dispensing signal to the chemical dispenser 46 shown in FIG. 1 to dispense the desired chemical through the desired spray points, whether the lower spray points 48 or upper spray points 50, depending upon the article and/or soil on the article. Depending upon the type of article and/or the type of soil on the article, the step time may be controlled to allow the chemical additional contact time on the soiled surface. Liquid from the wash tank is then recirculated to wash the articles for a duration and at a direction as specified in FIG. 2. The articles are then rinsed for a duration and at a direction as specified in FIG. 2.

FIG. 4 illustrates an article-dependent wash cycle according to a possible embodiment of the present invention. As set forth above, articles to be cleaned are loaded for cleaning as shown in step 66. The user interface 42 on the cleaning apparatus 20 allows the operator or user to manually input the type of article and/or the soil type on the article. If the operator or user manually selects the article type as shown in step 70, the user interface 42, in one embodiment, provides a list of article types to the user to select based on the articles 34 loaded in the rack 36. The list of article types could include plates, cups, glasses, flatware, pots and pans, sheet pans, etc. Alternatively, the cleaning apparatus 20 may automatically detect the identifier associated with the article type in the rack 36 as shown in step 72 and described above. Once the ware type is detected, a wash cycle is activated encompassing steps 1, 2, 3 and 4 illustrated in FIG. 2 for both soft water and hard water scenarios. In the instance where hard water is used, the detergent concentration may be increased and/or chelant may be applied directly to the article. The controller 44 may be programmed to adjust the wash sequences of each wash cycle illustrated at FIG. 2 based upon a hard water signal received from a water sensor (not shown) in the cleaning apparatus 20. The water type is considered a component of a chemical combination for purposes of formulating the chemicals to use, the amount of chemical and detergent, the duration of wash and rinse cycles, etc. For example, the controller 44 automatically tailors the concentrate application sequence, wash sequence, rinse sequence, and/or detergent amount based upon the condition of the water. Water-type selections may include without limitation hard water, medium-hard water, soft water, distilled water, or RO (reverse osmosis) water, and other water quality or water source selections. The wash cycle identifies the chemical type based on the ware or soil type to be dispensed, the dispense sequence, the dispense time, the wash cycle duration and dispensing spray points for the chemical to be applied directly to the soiled surfaces of the article as illustrated in step 74. The wash and rinse sequences can also tailored similar to the concentrated product dispense sequence as shown at step 74. Before or after direct chemical application to soiled surfaces of the articles, the wash sequence or cycle may include a circulated wash as shown at step 76. The articles may be cleaned with recirculated wash shown at step 78 before or after a step in the wash cycle where chemical is applied directly to the soiled surface of the article. Similarly, following or preceding a recirculated wash, selected chemicals may be applied directly to the article for a desired amount of time, such as a soaking duration, from the top, bottom or both spray points 48 and 50 in the cleaning apparatus 20 as illustrated at step 80. Steps 78 and 80 may be repeated as illustrated in FIG. 2 until the cleaning cycle or sequence is complete as illustrated in step 82.

As discussed above, FIG. 2 includes illustrative wash cycles or sequences for varying article types including plates, cups, glasses, flatware, pots and pans, and aluminum sheet pans. Since the cleaning apparatus 20 is adapted to identify the type of article 34 to be cleaned based upon manual or automated detection, different concentrated chemical products are sprayed onto the individual types of ware according to the wash cycle or sequence illustrated in FIG. 2. The dispensing sequence is identified in FIG. 2 as step 1, 2, 3 and step 4 being the final rinse. These cumulative dispensing sequences represent the wash cycle for each article type. The dispensing sequence of the chemicals or the order in which each step occurs is dependent upon the article type. In each of the various dispensing sequences, certain steps may not be activated and are indicated by being X'd out for the appropriate cell in both tables illustrated in FIG. 2. The wash cycle may be further tailored based the water type, such as illustrated in the top table for soft water and the bottom table for hard water. Each dispensing sequence includes generally a step time or time required for the step to begin and end. Some dispensing sequences may not include spraying chemical onto the soiled surface of the article being cleaned. For example, the first dispensing sequence or step 1 for the plates illustrates such an instance where a concentrated chemical spray is not applied during the first dispensing sequence or steps. The dispensing sequence or step also includes a recirculated wash concentration indicating the detergent concentration for the liquid in the wash tank 26 of the cleaning apparatus 20. The dispensing sequence or step also includes the spray point location which may be applicable to not only the chemical being applied to the soil on the article but also the recirculation of the liquid in the wash tank 26 through either the lower wash spray arm and/or upper wash spray arm for a wash cycle and the lower rinse spray arm and/or the upper rinse spray arm for a rinse cycle. Thus, to conserve energy and to apply chemical, washing and rinsing liquids to the soiled or appropriate surface of the article, the controller 44 may control the dispensing point for the chemical, including the dispensing points of the wash liquid and rinse liquid. For example, the first step or dispensing sequence in the wash cycle for the plates includes spray of the recirculated wash having a 0.1% detergent concentration through the top or upper wash spray arms 32 in the cleaning apparatus 20. The concentration of the bulk wash may also be tailored for each water condition detected, as described above. The bulk wash often may include a lower concentration of detergent with the addition of the chemicals that are applied directly to the article that end up in the bulk wash liquid. Since the soiled surface of a plate is generally facing upward in the rack 36, dispensing liquid from the top spray arms provides the most efficient use of the cleaning apparatus 20 for removing soils from the soiled surfaces of the plates. In step 2, acid is sprayed from the upper spray points 50 onto the soiled surfaces of the plates and permitted to work, for example, for a duration of 4 seconds. The control of the delivery of the chemicals can be achieved by such methods as use of a settable timer. In step 3, liquid is pumped from the wash tank 26 through both the upper and lower wash spray arms 30 and 32 for a period of 25 seconds. Finally, step 4 or the fourth step in the dispensing sequence for the wash cycle includes rinsing the plates using the upper rinse spray arm 40 in the cleaning apparatus 20 for a duration of 10 seconds. In an embodiment of the present invention, the cycle duration is the minimum required by the National Sanitation Foundation ("NSF"). In another alternative embodiment, the cycle duration may be a pre-determined standard set for a particular system. Other combinations of time durations can be used. FIG. 2 illustrates exemplary dispensing cycles for various other article types. Cycle order combinations are as numerous as required.

The present invention contemplates use of various types of chemicals. A number of acids could be used, and the preferred acids may include citric acid, urea sulfate, methane sulfonic acid, gluconic acid, etc. Separate chemicals may be used independently such as oxidizers, chelators, enzymes, surfactants, etc. The detergent referenced in FIG. 2 may be an alkaline detergent such as a caustic-based or an ash-based detergent.

According to the present invention, the chemistries applied directly to the soiled surfaces of the articles is changed rather than recirculating the bulk wash liquid in the wash tank 26 as is traditionally done. Because of the volume of the water in the wash tank 26, the chemistry or detergent concentration cannot be changed rapidly and on-the-fly so that the wash and rinse cycles are tailored specifically to the article type, concentrated chemicals dispensed, water condition, etc. Also, in the present invention, concentrated product applied directly onto the article ends up in the wash tank 26 and is used for subsequent wash cycles. Applying the chemicals directly to the surface of the articles to be cleaned allows article specific chemicals to be used for each wash cycle without having to change the bulk wash tank chemistry in the wash tank 26. Furthermore, the present invention provides means for reducing the amount of chemical used since the chemical is applied directly to the soiled surface of the article as opposed the bulk wash tank to achieve a desired level of concentration for performing a similar cleaning function. The ability to control the direct application of chemical onto the soiled surface of the article without having to control the chemistry or concentration of the chemistry within the bulk wash tank provides savings in both the amount of chemistry being used and the water being used to perform the various wash and rinse cycles. The present invention also provides the flexibility of changing and tailoring, on the fly, the type of chemical being applied directly to the soiled surface of the article being cleaned without changing the bulk wash tank chemistry within the wash tank 26 of the cleaning apparatus 20. Additionally, the direction from which the chemical, wash and rinse liquid is applied to the article may also be changed and tailored, on the fly, to conserve energy, water, chemical and to prevent waste such as where chemical, wash or rinse liquids are being sprayed onto surfaces of an article that are generally unsoiled or clean. Controlling the direction of spray for the chemistry, wash and rinse liquids also allows each wash cycle to be specifically tailored to the type of article and its relative position and/or orientation on the rack 36 when positioned in the cleaning apparatus 20. For example, plates face generally upward and spraying chemical, wash and rinse liquids onto the back of the plate over the entire wash cycle is wasteful. Furthermore, since wash cycle time durations are often desirably short, the type of chemicals used to clean soil from the articles is generally aggressive and can damage and corrode both the cleaning apparatus and its components and the article being cleaned. For example, high acid levels can corrode low grade stainless flatware and utensils. By detecting the ware type and selecting the appropriate chemical and amount according to the specific ware, the present invention controls corrosion and damage to the article type, cleaning apparatus and its components while being sufficiently aggressive to clean even sensitive article types.

In an alternative embodiment, the types of articles washed could be kept track of and printed out, which is an additional benefit for the customer. For example, the user could obtain information about the dates and times article types are washed, and be able to adjust cleaning supply inventories accordingly. Also, the peak periods of usage of the cleaning apparatus may be tracked and reported. This may be used by the user, for example, to evaluate labor requirements and keep down labor costs. These types of reports could be viewed and/or printed out in either text or graphical form.

With the chemical, dispensing sequence and dispensing location optimized to the particular article and/or soil type, additional benefits would include the ability to do such things as rinse a rack of glasses with additional rinse additive; add a bleaching agent to a final rinse to help control staining; use more aggressive chemicals to wash pots and pans; fully optimize and blend formulas based on the article-type being washed; extend or shorten the wash time based on the article being washed; provide different final rinse options for sanitizing or for water spotting control. These would further result in fewer rewashes and less staining, along with more efficient cycle sequences and durations.

While the system hereinbefore described as effectively adapted to fulfill the afore mentioned objects, it is to be understood that the invention is not intended to be limited to the specific preferred embodiments of the cleaning apparatus and method set forth above. Rather, it is to be taken as including all reasonable equivalents to the subject matter of the appended claims.

What is claimed is:

1. An automated cleaning method for a cleaning apparatus having a wash tank and utilizing a wash liquid comprising:

identifying a type of article to be cleaned, said type of article positioned at least partially within the wash tank;

determining a product in concentrated form to dispense based on the identified type of the article to be cleaned and a water type, wherein the concentrated product comprises oxidant, chelant, enzyme, or surfactant;

increasing a detergent concentration in the wash liquid from a baseline concentration if hard water is detected;

sensing a water condition with a water condition sensor;

tailoring, with a controller, a product dispensing sequence, a wash sequence, a rinse sequence, or a detergent amount based upon the type of article and the water condition;

directly applying article with the product in concentrated form with one of the lower spray points and upper spray points to the article, based, at least in part, on the identified type of the article; and cleaning the article at least in part with the wash liquid.

2. The method of claim 1 wherein determining comprises detecting an identifier associated with the type of the article.

3. The method of claim 1 further comprising identifying the product dispensing sequence based on the type of the article.

4. The method of claim 1 wherein determining comprises following a dispensing instruction wherein said dispensing instruction is based on the type of the article being cleaned with the automated cleaning method.

5. The method of claim 1 further comprising controlling location of product application on the article based on the type of the article.

6. The method of claim 1 further comprising determining a product in concentrated form to dispense based on a type of soil on the article.

7. An automated cleaning method comprising:

providing a cleaning apparatus having lower spray points, upper spray points, a chemical dispenser including a plurality of concentrated products, and a wash tank including a wash liquid;

identifying a type of article comprising a ware to be cleaned, said ware positioned at least partially within the wash tank;

determining at least one of the plurality of concentrated products to dispense onto the ware based on the type article of the ware, said concentrated product selected from the plurality of products in concentrated form in the chemical dispenser for cleaning different types of articles;

tailoring, with a controller, a product dispensing sequence, a wash sequence, a rinse sequence, or a detergent amount based upon the type of article and a water condition;

directly spraying the ware with the concentrated product via one or both of the lower spray points and upper spray points;

controlling the time the concentrated product contacts the article;

cleaning the ware with the wash liquid;

recirculating the wash liquid within the cleaning apparatus to provide additional cleaning; and determining, based on the identified type of article, if additional product in concentrated form is to be applied directly to the article and if so, directly applying the additional product to the article.

8. The method of claim 7 wherein determining comprises detecting an identifier associated with the type of article of the ware.

9. The method of claim 7 wherein determining comprises identifying at least one of:

a. a product dispensing sequence based on the type article of the ware;

b. a wash sequence based on the type of article of the ware;

c. a rinse sequence based on the type of article of the ware.

10. The method of claim 7 wherein determining comprises following a dispensing instruction wherein said dispensing instruction based on the type of article of the ware.

11. The method of claim 9 further comprising controlling location of where the product is directly applied on a surface of the ware based on the type of article of the ware and on the product dispensing, wash or rinse sequence.

12. The method of claim 7 further comprising controlling location of where the product is directly applied on a surface of the ware based on a soil type.

13. The method of claim 7 further comprising determining a concentrated product to dispense directly onto the ware based on a soil type.

14. The method of claim 7 further comprising inputting a product sequence dispensing instruction into the controller based on the water condition.

15. The method of claim 1 further comprising determining, based on the identified type of article, if additional product in concentrated form is to be applied directly to the article and if so, directly applying the additional product to the article.

16. The method of claim 15 wherein the additional product in concentrated form is applied from lower spray points or upper spray points of a cleaning apparatus based upon the identified type of article.

17. The method of claim 2 wherein the cleaning apparatus comprises a control device which provides a concentrated product dispensing signal to dispense the product in concentrated form.

18. The method of claim 17 wherein the dispensing signal is based on the detection of the identifier.

19. The method of claim 1 further comprising operating the cleaning apparatus with a user interface.

* * * * *